United States Patent [19]

Tachibana et al.

[11] 4,427,764

[45] Jan. 24, 1984

[54] PROTECTIVE COATING FOR SILVER HALIDE PHOTOGRAPHIC LIGHT-SENSITIVE MATERIAL

[75] Inventors: Noriki Tachibana, Yokohama; Morio Kobayashi, Sagamihrara; Noboru Fujimori, Hino, all of Japan

[73] Assignee: Konishiroku Photo Industry Co., Ltd., Japan

[21] Appl. No.: 439,437

[22] Filed: Nov. 5, 1982

[30] Foreign Application Priority Data

Nov. 19, 1982 [JP] Japan ..... 57-185672

[51] Int. Cl.[3] ..... G03C 1/78

[52] U.S. Cl. ..... 430/523; 430/961

[58] Field of Search ..... 430/961, 635, 631, 523

[56] References Cited

U.S. PATENT DOCUMENTS

| | | | |
|---|---|---|---|
| 4,013,696 | 3/1977 | Babbitt et al. | 430/961 |
| 4,042,399 | 8/1977 | Kiesslich | 430/961 |
| 4,267,265 | 5/1981 | Sugimoto et al. | 430/961 |

*Primary Examiner*—Jack P. Brammer

*Attorney, Agent, or Firm*—Finnegan, Henderson, Farabow, Garrett & Dunner

[57] ABSTRACT

Light sensitive silver halide materials with a protective layer have improved slidableness and scratch resistance properties.

7 Claims, No Drawings

PROTECTIVE COATING FOR SILVER HALIDE PHOTOGRAPHIC LIGHT-SENSITIVE MATERIAL

The present invention relates to a silver halide photographic light-sensitive material which is improved on the physical properties thereof, and more particularly to a silver halide photographic light-sensitive material which is improved on the slidableness and scratch resistance thereof.

Generally, a silver halide photographic light-sensitive material comprises such a support as made of paper, glass, cellulose ester film, polyester film, or the like, and at least one silver halide light-sensitive material layer coated on the support. In that case, as the binder material for the silver halide, a hydrophilic colloid, particularly gelatin, is normally used.

The coated layer of the silver halide photographic light-sensitive material comprising gelatin has a high friction coefficient with the surface of metal or of gelatin. Consequently, in general, a silver halide photographic light-sensitive material that uses as the binder thereof a hydrophilic colloid, particularly gelatin has the serious disadvantage that the surface of the light-sensitive material is prone to get scratched when coming into contact with or in friction with other materials. Especially in a silver halide photographic light-sensitive material, since the silver halide used as the light-sensitive substance thereof is also keenly sensitive to pressure, those scratches produced on the sensitive material by contacts, frictions, etc., cause at times fog or desensitization by pressure, which has a fatal influence upon the resulting image.

For this reason, there have been proposed various methods for increasing the scratch-resistant strength of the photographic component layer of a silver halide photographic light-sensitive material as well as for reducing the sliding friction of the silver halide photographic light-sensitive material; for example, there have been known such methods as the addition of a certain gelatin hardener to the photographic component layer of a photographic film to increase the scratch-resistant strength thereof as described in British Pat. No. 1,270,578; the concurrent incorporation of dimethyl silicone with a specific surface active agent into the photographic emulsion layer or protective layer of a photographic film to thereby render the film slidable as described in U.S. Pat. No. 3,042,522; the coating of a mixture of dimethyl silicone with diphenyl silicone on the backing of the base of a photographic film to thereby render the film slidable as described in U.S. Pat. No. 3,080,317; the incorporation of a fatty acid ester into the backing of the base or into the protective layer of a photographic film to thereby render the film slidable as described in British Pat. No. 1,466,304, U.S. Pat. No. 3,121,060, and Japanese Patent Publication Open to Public Inspection (hereinafter referred to as Japanese Patent O.P.I. Publication) Nos. 141623/1976 and 159221/1979; the incorporation of methyl-phenyl silicone with triphenyl terminal block into the protective layer of a photographic film to thereby render the film slidable as described in British Pat. No. 1,143,118; and the like.

These are all effective methods having their respective excellent advantages, but, on the other hand, have such accompanying disadvantages, for example, that some of these methods, after photographic processing, cause the film base to become turbid white (the socalled "haze"), some have an adverse effect upon the coating characteristics at the time of manufacture of a silver halide photographic light-sensitive material, and some others weaken the adhesion strength of the film binder material to the film base, and the like.

It is an object of the present invention to provide a silver halide photographic light-sensitive material that is improved on the slidableness as well as on the scratch-resistant strength thereof without impairing the photographic characteristics, transparency (no haze phenomenon occurs on the base), coatability, adhesiveness, and the like.

The above-described object of the present invention can be attained by incorporating into at least one of the surface layers of a silver halide photographic light-sensitive material at least one of those compounds having the formula:

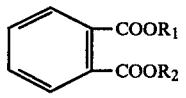

wherein $R_1$ and $R_2$ each represents an alkyl group having from 12 to 24 carbon atoms.

An alkyl group in the above formula is allowed to be of either a straight chain or branched chain, and also allowed to have a substituent. The preferred alkyl is of an unsubstituted straight chain.

The following are examples of those compounds having the foregoing formula, but those applicable to the present invention are not limited to the following examples:

Exemplified compounds:

1. 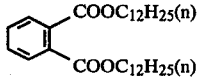

2. 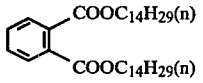

3. 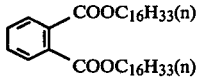

4. 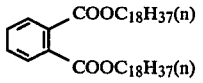

5. 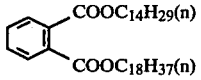

6. 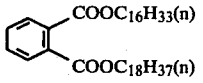

7. 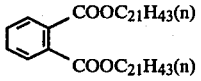

8. 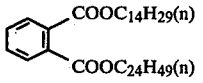

These compounds for use in the present invention (hereinafter referred to as the sliding agent of the present invention) may be synthesized in a general manner. For example, the compound may be readily synthesized by an ordinary esterification reaction of phthalic acid or phthalic anhydride; i.e., the reaction of phthalic acid or phthalic anhydride with an aliphatic monohydric alcohol in the presence of a catalyst or condensing agent such as p-toluene sulfonic acid, sulfuric acide, and the like.

The compound of the present invention, singly or in combination of two or more kinds thereof, may be dispersed into a water phase or a hydrophilic colloidal solution such as, e.g., an aqueous gelatin solution. In addition, the compound of the present invention also may, after being dissolved into a low-boiling solvent, high-boiling solvent, or a mixture of low- and high-boiling solvents, be dispersed into a water phase or the foregoing hydrophilic colloidal solution in the presence of a dispersing agent.

As the dispersing agent, there may be used those surface active agents generally available for photographic use which include, e.g., anionic surfactants, nonionic surfactants, amphoteric surfactants, and cationic surfactants. One arbitrarily selected from these surface active agents is used to disperse the compound of the present invention dissolved in a solvent using an ultrasonic homogenizer or a valve homogenizer so that the dispersed particle size becomes from 0.1 to 10$\mu$ to prepare an emulsion of the o/w type, and then the resulting dispersed liquid is added to an aqueous gelatin solution, which is subsequently incorporated into at least either one of the outermost protective layer and the backing layer of a silver halide photographic light-sensitive material, thereby obtaining a silver halide photographic light-sensitive material that is well slidable and hardly gets scratched when coming in touch with, e.g., a package material, packaging machine, camera, processing machine, and the like.

As the high-boiling solvent, those solvents as described in, e.g., U.S. Pat. No. 2,322,027 may be used. As the low-boiling solvent, methanol, ethanol, acetone, ethyl acetate, ethyl Cellosolve, and the like, may be used. These sliding agents applicable to the present invention, whether used singly or in combination with high-boiling and low-boiling solvents, results in almost the same effect.

These sliding agents of the present invention, when used in a quantity of from 0.3 to 30% to such a water-soluble binder material as, e.g., gelatin, which is to form the protective layer and backing layer, provide the layers with particularly desirable surface physical properties.

These sliding agents of the present invention can be applied to various silver halide photographic light-sensitive materials; particularly can be advantageously applied to those silver halide photographic light-sensitive materials of the type using a hydrophilic colloid as the binder thereof, e.g., those silver halide photographic light-sensitive materials which use gelatin as the binder thereof.

Those hydrophilic colloids advantageously usable in the present invention include, in addition to gelatin, gelatin derivatives, colloidal albumin, agar-agar, gum arabic, alginic acid, such cellulose derivatives as, e.g., those cellulose acetates hydrolyzed to an extent of from 19 to 26% acetyl content, acrylamides, imidated polyacrylamides, casein, vinyl alcohol polymers containing an urethane carboxylic acid group or a cyanoacetyl group such as, e.g., vinyl alcohol-vinyl cyanoacetate copolymers, polyvinyl alcohols, polyvinyl pyrrolidones, hydrolyzed polyvinyl acetates, those polymers obtained by the polymerization of a protein or a saturated acylated protein with a monomer having a vinyl group, and the like.

In the present invention, it is desirable to use, at need, for the purpose of improving the physical characteristics of the coating layers comprising the foregoing hydrophilic colloid, various coating layer's physical characteristic-improving agents such as, e.g., hardening agents. If, for example, a hardening agent is used together, not only is a synergetic effect obtained on the slidableness, the effect of the present invention, and the scratch resistance but also the mechanical strength and dissolution resistance in a processing solution may be further improved, so that a very satisfactory layer's physical characteristics having photographic material can be obtained.

In the case where gelatin is used as a hydrophilic colloid, applicable typical examples of hardening agents include such various hardening agents as of aldehydes, epoxys, ethylene immines, active halogens, vinyl sulfones, isocyanates, sulfonic acid esters, carbodiimides, mucochloric acids, acyloyls, and the like.

These gelatin hardening agents applicable to the present invention are described in, e.g., U.S. Pat. Nos. 3,539,644, 3,642,486, 2,726,162, 2,816,125, and 3,047,394, West German Pat. No. 1,085,663, British Pat. No. 1,033,518, Japanese Patent Examined Publication No. 3549/1973, PB Report No. 19921, U.S. Pat. Nos. 2,950,197, 2,964,404, 2,983,611, 3,271,175, 2,938,892, 3,640,720, 3,058,827, and 2,994,611, British Pat. Nos. 822,061, 1,049,083, 1,202,052, and 1,230,353, West German Pat. No. 872,153, Japanese Patent Examined Publication Nos. 29622/1969, 6151/1972, 25373/1972, 8736/1972, and 38715/1971, Japanese Patent O.P.I. Publication Nos. 73122/1974, 74832/1973, 24435/1974, 43319/1973, 43320/1973, 116154/1974, 63061/1975, 62256/1975, and 21059/1977, and the like.

The quantity of the hardening agent to be used should be in such an arbitrary range as not to impair the effect of the present invention according to the kind of an objective gelatin layer, required physical characteristics, and photographic characteristics, and the agent is desirable to be contained in a quantity of at least not less than 0.01% by weight, preferably not less than 1% by weight, of the gelatin derivative of the present invention in the dried condition.

To the hydrophilic colloid to be used in the present invention may, at need, be added as photographic additives in addition to the foregoing hardening agent within such a range as not to impair the effect of the present invention, for example, a gelatin plasticizer, surface active agent, ultraviolet absorbing agent, antistain agent, pH control agent, antioxidation agent, antistatic agent, viscosity increasing agent, graininess-improving agent, dyes, mordant, brightening agent, developing rate control agent, matting agent, and the like.

Among the above-described various additives, those particularly preferably usable in the present invention include, e.g., as viscosity-increasing agents or plasticizers, those materials, particularly, styrene-sodium maleate copolymer, dextran sulfate, and the like, as described in, e.g., U.S. Pat. No. 2,960,404, Japanese Patent Examined Publication No. 4939/1968, West German Pat. No. 1,904,604, Japanese Patent O.P.I. Publication No. 63715/1973, Japanese Patent Examined Publication No. 15462/1970, Belgian Pat. No. 762,833, U.S. Pat. No. 3,767,410, and Belgian Pat. No. 558,143; as ultraviolet absorbing agents, those compounds, particularly, 2-(2'-hydroxy-5'-t-butyl-phenyl) benzotriazole, 2-(2'-hydroxy-3',5'-di-t-butyl-phenyl)benzotriazole, 2-(2'-hydroxy-3'-t-butyl-5'-butyl-phenyl)-5-chlorobenzotriazole, 2-(2'-hydroxy-3',5'-di-t-butyl-phenyl)-5-chlorobenzotriazole, and the like, as described in, e.g., Japanese Patent Examined Publication Nos. 736/1973, 5496/1973, 41572/1973, 30492/1973, and 31255/1973, U.S. Pat. No. 3,253,921, and British Pat. No. 1,309,349; as surface active agents, those compounds, particularly, sodium di-2-ethyl-hexyl-sulfosuccinate, sodium amyl-decyl-sulfosuccinate, sodium dodecylbenzene-sulfonate, sodium triisopropyl-naphthalene-sulfonate, and the like, as described in, e.g., British Pat. Nos. 548,532 and 1,216,389, U.S. Pat. Nos. 3,026,202 and 3,514,293, Japanese Patent Examined Publication Nos. 26580/1969, 17922/1968, 17926/1968, 13166/1968, and 20785/1973, French Pat. No. 202,588, Belgian Pat. No. 773,459, and Japanese Patent O.P.I. Publication No. 101118/1973, and the like; as antistain agents, those compounds, particularly, 2-methyl-5-hexadecyl-hydroquinone, 2-methyl-5-sec-octadecyl-hydroquinone, 2,5-di-t-octyl-hydroquinone, and the like, as described in, e.g., U.S. Pat. Nos. 2,360,210, 2,728,659, 2,732,300, 3,700,453, and the like; as antistatic agents, those compounds as described in, e.g., Japanese Patent Examined Publication No. 24159/1971, Japanese Patent O.P.I. Publication No. 89979/1973, U.S. Pat. Nos. 2,882,157 and 2,972,535, Japanese Patent O.P.I. Publication Nos. 20785/1973, 43130/1973, and 90391/1973, Japanese Patent Examined Publication Nos. 39312/1971, 43809/1973, 4853/1974, 64/1974, and 8742/1972, and Japanese Patent O.P.I. Publication No. 33627/1972, and the like; and as matting agents, those compounds, particularly, silica gel having a particle size of from 0.5 to 20μ, polymethyl-methacrylate polymer having a particle size of from 0.5 to 20μ, and the like, as described in, e.g., British Pat. No. 1,221,980, U.S. Pat. Nos. 2,992,101 and 2,956,884.

Typical examples of those materials for the support to be used in the present invention include, for example, baryta paper, polyethylene-coated paper, polypropylene-synthetic paper, a glass plate, cellulose acetate, cellulose nitrate, polyester film such as of, e.g., polyethylene terephthalate, polyamide film, polypropylene film, polycarbonate film, polystyrene film, and the like, and these support materials may be arbitrarily selected according to the respective purposes of photographic light-sensitive materials.

Typical examples of the silver halide photographic light-sensitive material of the present invention includes those photographic materials of the type using a silver halide as the light-sensitive component thereof such as, e.g., negative light-sensitive materials for general use, reversal light-sensitive materials for general use, positive light-sensitive materials for general use, direct-positive light-sensitive materials, silver halide photographic light-sensitive materials for special uses such as for graphic arts use, for X-ray, high-resolution, infrared, and ultraviolet photography uses, and the like.

The present invention is illustrated in detail with reference to examples below, but the present invention is not limited thereto:

EXAMPLE 1

Dispersed liquids of various exemplified sliding agents were prepared as follows:

| | |
|---|---|
| Liquid A | |
| A sliding agent | 0 or 2 g |
| Dioctyl phthalate | 0 or 2 g |
| Ethyl acetate | 1 g |
| Liquid B | |
| 5% aqueous gelatin solution | 20 ml |
| Sodium triisopropyl-naphthalene-sulfonate | 2 g |
| Liquid C | |
| 7% aqueous gelatin solution | 50 ml |

A mixture of liquid A with liquid B was emulsified under pressure of 250 kg/cm$^2$ by use of a valve-type homogenizer manufactured by Manton Gaulin, thereby obtaining an o/w-type dispersed liquid. At this time, the particle size of the dispersed material in the aqueous gelatin solution was controlled so as to become about 0.8μ. To the thus obtained dispersed liquid was added liquid C, then water was added to make the whole quantity 80 ml to thereby prepare a sliding agent-dispersed liquid.

70 ml of the thus prepared sliding agent-dispersed liquid were used to prepare a coating liquid in the following prescription:

| | |
|---|---|
| Liquid D | |
| Sliding agent-dispersed liquid | 70 ml |
| Gelatin | 49 g |
| Sodium amyl-decyl-sulfosuccinate | 1 g |
| Polystyrene maleate | 1 g |
| Formaldehyde | 0.1 g |
| Mucochloric acid | 0.1 g |
| Water to make | 1000 ml |

On the other hand, on one side of a transparent polyethylene terephthalate film was coated a subbing layer, on which was then coated a silver iodobromide photographic light-sensitive emulsion containing 7 mol% silver iodide, on which was further coated, as a protective layer, the above coating liquid (liquid D), and then dried to thereby prepare a sample.

The thus obtained sample was subjected to tests to determine coefficient of friction and the minimum load that can cause scratches. The measurement of coefficient of friction was made in accordance with ASTM, D-1814, and the results were indicated with the coefficient of kinetic friction against a photographic film backing paper. The measurement of the load to cause scratches was made by imposing continuously weight upon a needle having a needle point with the diameter of 0.1 mm to scratch the surface of film, and the minimum load that can cause a scratch was measured. Further, these samples, after being exposed through an optical wedge to a white light in accordance with the JIS method by use of a sensitometer Model KS-1 (manufactured by Konishiroku Photo Industry Co., Ltd.), were subjected to a high temperature rapid processing at 40° C. for 30 seconds in a continuous roller transport type automatic processor capable of consistently developing, fixing, washing and drying by use of a developer having the following composition:

| | |
|---|---|
| Developer | |
| Anhydrous sodium sulfite | 70 g |
| Hydroquinone | 10 g |
| Anhydrous boric acid | 1 g |
| Sodium carbonate, monohydrated | 20 g |
| 1-phenyl-1,3-pyrazolidone | 0.35 g |
| Sodium hydroxide | 5 g |
| 5-methyl-benzotriazole | 0.05 g |
| Potassium bromide | 5 g |
| Glutar-aldehyde hydrogensulfite | 15 g |
| Glacial acetic acid | 8 g |
| Water to make 1 liter | |

For fixing, a generally known fixer was used. The thus obtained samples were subjected to sensitometry tests to measure the sensitivities and fog thereof. The results obtained are as shown in Table 1. In addition, the sensitivity of each sample in the table is indicated with the relative value to the value regarded as 100 of the sensitivity of the comparative sample (sample No. 1) under the condition of 20° C. with 60% RH.

TABLE 1

| Sample No. | Sliding agent and adding quantity (g) | High boiling solvent and adding quantity (g) | Coefficient of friction | Minimum load (g) to cause scratch | Photographic characteristics Sensitivity | Fog |
|---|---|---|---|---|---|---|
| 1 | — | — | 0.67 | 95 | 100 | 0.20 |
| 2 | Comparative compound A(2) | — | 0.49 | 170 | 100 | 0.21 |
| 3 | Comparative compound B(2) | — | 0.46 | 175 | 100 | 0.20 |
| 4 | Exemplified compound 2(2) | — | 0.39 | 190 | 100 | 0.20 |
| 5 | Exemplified compound 3(2) | — | 0.39 | 195 | 100 | 0.20 |
| 6 | Exemplified compound 4(2) | — | 0.40 | 190 | 100 | 0.21 |
| 7 | Exemplified compound 5(2) | — | 0.41 | 195 | 105 | 0.20 |
| 8 | Exemplified compound 6(2) | — | 0.39 | 195 | 100 | 0.21 |
| 9 | Exemplified compound 2(1) Exemplified compound 4(1) | — | 0.40 | 190 | 100 | 0.21 |
| 10 | Exemplified compound 3(1.5) Exemplified compound 4(0.5) | — | 0.40 | 195 | 105 | 0.20 |
| 11 | Exemplified compound 3(2) | Dioctyl phthalate(2) | 0.40 | 195 | 100 | 0.20 |
| 12 | Exemplified compound 4(2) | Dioctyl phthalate(2) | 0.41 | 190 | 100 | 0.20 |
| 13 | Exemplified compound 3(1.5) Exemplified compound 4(0.5) | Dioctyl phthalate(2) Dioctyl phthalate(2) | 0.40 | 190 | 100 | 0.21 |

Comparative compound A:

$$n\text{—}C_{15}H_{31}COOC_{20}H_{41}(n)$$

Comparative compound B:

$$\begin{array}{l} CH_2OCOC_{15}H_{31}(n) \\ | \\ CHOCOC_{15}H_{31}(n) \\ | \\ CH_2OCOC_{15}H_{31}(n) \end{array}$$

As apparent from Table 1, it is understood that the samples of the present invention (No. 4 to No. 13) show smaller coefficients of friction than those of the comparative samples (No. 1 to No. 3), and therefore have excellent scratch-reducing effects. And also it is understood that the samples have so excellent transparency that they exert no bad influence upon the photographic characteristics (sensitivity and fog).

EXAMPLE 2

Dispersed liquids of various exemplified sliding agents were prepared as follows:

| | |
|---|---|
| Liquid A | |
| A sliding agent | 2 g |
| Ethyl acetate | 1 g |
| Liquid B | |
| 5% aqueous gelatin solution | 20 ml |
| Sodium triisopropyl-naphthalene-sulfonate | 2 g |
| Liquid C | |
| 7% aqueous gelatin solution | 50 ml |

Liquid A and liquid B were mixed in a similar manner to that in Example 1, and the mixture was added to liquid C to thereby obtain a sliding agent-dispersed liquid. 70 ml of the resulting sliding agent-dispersed liquid were taken to prepare a coating liquid according to the following prescrition:

| | |
|---|---|
| Liquid D | |
| Sliding agent-dispersed liquid | 70 ml |
| Gelatin | 40 g |
| Sodium di-2-ethyl-hexyl-sulfosuccinate | 1 g |
| Dextran sulfate | 2 g |
| 1,2-bis(vinyl-sulfonyl)ethane | 1 g |
| N,N',N''—triacryloyl-1,3,5-hexahydrotriazine | 1 g |
| Matting agent (silica gel) | 0.5 g |
| Water to make | 1000 ml |

On the other hand, on one side of a cellulose triacetate film base was coated a subbing layer, on which were coated in order a red-sensitive silver iodobromide emulsion layer containing a cyan coupler and 6 mol% silver iodide, a green-sensitive silver iodobromide emulsion layer containing a magenta coupler and 6 mol% silver iodide, and a blue-sensitive silver iodobromide emulsion layer containing an yellow coupler and 6 mol% silver iodide. On the thus produced silver halide multilayered color photographic light-sensitive material was coated the foregoing liquid D to thereby obtain samples as indicated in Table 2. Each of these samples was subjected to measurement of coefficient of friction in the same manner as in Example 1, and also was processed at 38° C. for 3 minutes in a color developer containing, as a developing agent, 4-amino-3-methyl-N-ethyl-N-hydroxyethyl-aniline sulfate, bleached subsequently in a normal manner, fixed, washed and then dried, and, after that, was subjected to measurement of coefficient of friction. On the other hand, each sample, after being exposed through an optical wedge to white light, was subjected to color development and post processings in the same manner as in above, and then to sensitometry to measure the sensitivity and fog thereof.

The results of the measurements are as shown in Table 2. In addition, the sensitivities of each sample are indicated in the table with the relative values obtained in the densitometry through color filters to the values, each regarded as 100, of the comparative sample (sample No. 14).

The "B", "G" and "R" shown in the table mean that the color densities were obtained by measuring through blue, green, and red filters, respectively, in the sensitometry.

TABLE 2

| Sample No. | Sliding agent | Coefficient of friction before processing | Coefficient of friction after processing | Photographic characteristics: Sensitivity B | Sensitivity G | Sensitivity R | Fog B | Fog G | Fog R |
|---|---|---|---|---|---|---|---|---|---|
| 14 | — | 0.68 | 0.70 | 100 | 100 | 100 | 0.08 | 0.08 | 0.10 |
| 15 | Comparative compound A | 0.45 | 0.47 | 100 | 100 | 100 | 0.09 | 0.09 | 0.10 |
| 16 | Comparative compound B | 0.48 | 0.51 | 105 | 100 | 100 | 0.08 | 0.08 | 0.11 |
| 17 | Exemplified compound 2 | 0.40 | 0.41 | 100 | 100 | 100 | 0.09 | 0.08 | 0.10 |
| 18 | Exemplified compound 3 | 0.39 | 0.39 | 100 | 105 | 105 | 0.08 | 0.08 | 0.11 |
| 19 | Exemplified compound 4 | 0.40 | 0.42 | 105 | 105 | 100 | 0.08 | 0.08 | 0.10 |
| 20 | Exemplified compound 6 | 0.39 | 0.40 | 100 | 100 | 100 | 0.09 | 0.08 | 0.11 |
| 21 | Exemplified compound 3 | 0.39 | 0.40 | 100 | 100 | 105 | 0.09 | 0.08 | 0.10 |
| 22 | Exemplified compound 4 | 0.40 | 0.41 | 100 | 105 | 100 | 0.08 | 0.09 | 0.10 |
| 23 | Exemplified compound 6 | 0.40 | 0.40 | 105 | 100 | 100 | 0.08 | 0.08 | 0.10 |

As seen from Table 2, it is understood that the samples in which the sliding agents of the present invention are incorporated (sample No. 17 to sample No. 23) become little different in the friction coefficient-reducing effect even after the development. And also it is understood that the addition of the sliding agents exert no bad influence upon the photographic characteristics.

What is claimed is:

1. A silver halide photogrpahic light-sensitive material which comprises at least one surface layer containing a compound having the following formula:

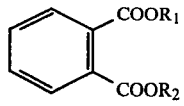

wherein $R_1$ and $R_2$ independently represent an alkyl group having from 12 to 24 carbon atoms.

2. A material according to claim 1, wherein the alkyl group is of an unsubstituted straight chain.

3. A material according to claim 1, wherein the surface layer is a protective layer.

4. A material according to claim 1, wherein the surface layer is a backing layer.

5. A material according to claim 1, wherein the amount of the compound is from 0.3 to 30 wt % to a binder consisting of the surface layer.

6. A material according to claim 5, wherein the binder is gelatine.

7. A material according to claim 1, further comprising a hardening agent.

* * * * *